US006923314B2

(12) United States Patent
Marco

(10) Patent No.: US 6,923,314 B2
(45) Date of Patent: Aug. 2, 2005

(54) BANDED CONTAINER PACKAGE WITH OPENING FEATURE

(75) Inventor: Leslie S. Marco, Bloomingdale, IL (US)

(73) Assignee: Illinois Tool Works Inc., Glenview, IL (US)

( * ) Notice: Subject to any disclaimer, the term of this patent is extended or adjusted under 35 U.S.C. 154(b) by 107 days.

(21) Appl. No.: 10/301,212

(22) Filed: Nov. 21, 2002

(65) Prior Publication Data

US 2004/0055906 A1 Mar. 25, 2004

Related U.S. Application Data

(63) Continuation-in-part of application No. 10/251,312, filed on Sep. 20, 2002.

(51) Int. Cl.[7] ..... B65D 75/00
(52) U.S. Cl. ..... 206/143; 206/434
(58) Field of Search ..... 206/141, 143, 206/147, 148, 144, 150, 151, 155, 156, 162, 165, 434, 427, 192; 294/87.2

(56) References Cited

U.S. PATENT DOCUMENTS

| | | | |
|---|---|---|---|
| 2,359,297 | A | 10/1944 | Brogden |
| 3,084,792 | A | 4/1963 | Poupitch |
| 3,118,537 | A | 1/1964 | Copping |
| 3,186,544 | A | 6/1965 | Curry et al. |
| 3,302,783 | A | 2/1967 | Lyon |
| 3,330,408 | A | 7/1967 | Wanderer |
| 3,385,429 | A | 5/1968 | Becker et al. |
| 3,447,675 | A | 6/1969 | Kirby |
| 3,504,790 | A | 4/1970 | Owen |
| 3,509,684 | A | 5/1970 | Hohl et al. |
| 3,515,272 | A | 6/1970 | Von Gal |
| 3,570,663 | A | 3/1971 | Cunningham |
| 3,687,282 | A | 8/1972 | Owen |
| 3,700,275 | A | 10/1972 | Deasy |
| 3,721,337 | A | 3/1973 | Braun et al. |
| 3,734,280 | A | 5/1973 | Amneus et al. |
| 3,784,003 | A | 1/1974 | Bolton |
| 3,923,155 | A | 12/1975 | Tanzer |
| 4,066,166 | A | 1/1978 | Klygis |
| 4,121,401 | A | 10/1978 | Duerr et al. |
| 4,269,308 | A | 5/1981 | Platt |
| 4,289,236 | A | 9/1981 | Ganz et al. |
| 4,296,858 | A | 10/1981 | Platt |
| 4,300,681 | A | 11/1981 | Klygis et al. |
| 4,354,333 | A | 10/1982 | McArdle |
| 4,385,690 | A | 5/1983 | Olsen |
| 4,386,698 | A | 6/1983 | Klygis |
| 4,460,084 | A | 7/1984 | Miller |
| 4,471,870 | A | 9/1984 | Uhlig |
| 4,520,924 | A | 6/1985 | Edwards et al. |
| 4,523,676 | A | 6/1985 | Barrash |
| D286,020 | S | 10/1986 | Barrash |
| 4,628,666 | A | 12/1986 | Lems |
| 4,807,751 | A | 2/1989 | Klygis et al. |
| 4,815,589 | A | 3/1989 | Allen et al. |
| 4,828,110 | A | 5/1989 | Lems |

(Continued)

FOREIGN PATENT DOCUMENTS

| | | |
|---|---|---|
| WO | WO 99/67138 | 12/1999 |

*Primary Examiner*—Shian T. Luong
(74) *Attorney, Agent, or Firm*—Taylor & Aust, P.C.

(57) ABSTRACT

A package for containers such as beverage bottles and cans includes a carrier with an array of loops, one loop provided for surrounding each container. A sleeve surrounds the group of containers held by the carrier. The carrier includes perforations, slits and frangible links for tearing the carrier and releasing containers individually. The sleeve includes parting lines allowing separated portions of the carrier to be pulled through the sleeve as the containers are released.

17 Claims, 4 Drawing Sheets

U.S. PATENT DOCUMENTS 4,893,712 A 1/1990 Allen ..... 206/150
4,919,265 A 4/1990 Lems et al.
4,932,528 A 6/1990 Benno
5,154,289 A 10/1992 Van Erden
5,425,446 A 6/1995 Weaver et al.
5,437,370 A 8/1995 Marco
5,452,794 A 9/1995 DiVietro
5,467,870 A 11/1995 Broskow et al.
5,487,463 A 1/1996 Harris
5,505,304 A 4/1996 Broskow et al.
5,642,808 A 7/1997 Marco et al.
5,701,994 A 12/1997 Marsh
6,145,656 A 11/2000 Marco ..... 206/147
6,213,293 B1 4/2001 Marco
6,415,917 B1 7/2002 Marco ..... 206/147

BANDED CONTAINER PACKAGE WITH OPENING FEATURE

CROSS REFERENCE TO RELATED APPLICATION

The present application is a continuation-in-part of co-pending U.S. patent application Ser. No. 10/251,312 filed on Sep. 20, 2002.

FIELD OF THE INVENTION

The present invention relates to packages for groups of containers, and, more particularly, to opening features for container packages including plastic carriers having arrays of loops for engaging and holding individual containers, and sleeves surrounding the groups of containers.

BACKGROUND OF THE INVENTION

Container carriers are used frequently to unitize a plurality of containers, such as bottles or cans, into conveniently saleable quantities. Both paperboard and plastic are materials commonly used. Paperboard carriers generally comprise a box in which the containers are held. The box may be totally enclosed, or may have an open top, with individual compartments for each container. Disadvantages of paperboard carriers include excess material and cost. Further, once opened, an enclosed box no longer holds the containers securely. An open top carrier can spill the contents therein, if inverted.

Plastic carriers have achieved wide acceptance for their performance, low weight, low cost and versatility in being adapted for containers of different sizes and shapes. The general design for plastic carriers includes apertures in a stretchable plastic material. The apertures are sized and shaped to stretch around the periphery of the containers to be held, either bottles or cans. For convenient carrying of a group of containers held by the carrier, various types of hand-grasps are known. Automated machinery is available for attaching stretchable plastic carriers to containers quickly and efficiently.

In one such known design, the carrier is formed from two webs of plastic material juxtaposed over one another. Handle portions and container engaging portions are stamped from the juxtaposed webs simultaneously. The webs are fused or welded along selected portions, such as by lamination. The resulting handle portion is thereby a double thickness of material, and the container engaging portions freely depend from the remainder of the carrier, at each side thereof. The container engaging portions are a single ply of material.

A problem experienced with some plastic carriers of this type is releasing the containers from the carrier. Prying or twisting one of the containers from the aperture in which it is held can be difficult, and the sudden release of a container can jar adjacent containers, causing other containers to be released in addition to the desired container.

A container carrier having a release feature allowing each container to be released individually, while retaining the remaining containers secured, is known from U.S. Pat. No. 5,642,800. This patent, which is commonly owned with the present invention, teaches a carrier having a plurality of apertures each for holding a separate container. An outer margin portion of the carrier includes a series of perforate lines and slits along which the outer margin portion can be torn. The slits are spaced from the perforate lines by a breakable link area to redirect the tearing force from one tear-completed perforate line to the next adjacent untorn perforate line. Tearing the margin portion along the perforate lines successively releases first one of the containers, and then another, until all containers are released.

A trend in the beverage industry is to group larger quantities of containers for sale. A large group of containers, whether bottles or cans, secured only by stretchable rings in an array of a plastic carrier, might have a feel of instability, with individual containers allowed to skew or twist relative to other containers in the group. Even with smaller quantities of containers, such as six-packs, the feeling of insecurity can occur as the containers twist and skew while being carried.

In a co-pending, commonly owned patent application entitled, "CONTAINER PACKAGE WITH CARRIER AND SURROUNDING SLEEVE", a plastic carrier is provided with an array of rings, including one ring for each container, and a stretchable sleeve for surrounding and securing the group of containers. If a carrier having the easy opening feature described above is used, it is difficult to operate the release feature as the carrier array is nested within the sleeve, and the sleeve interferes with the tearing aspect of the carrier.

What is needed in the art is a well-secured container package that has an easy and convenient opening feature.

SUMMARY OF THE INVENTION

The present invention provides a plastic carrier with an array of rings having one ring for each container, and a stretchable sleeve for surrounding and securing the group of containers. The carrier has outer margin portions with tear lines for releasing the containers, and the sleeve has a parting line that opens progressively as the carrier is torn.

In one form thereof, the invention provides a package for a group of containers including individual containers to be held in rows. The package has an integral plastic carrier including a container holding portion of interconnected stretchable loops, one loop for each container. Each loop surrounds a different one of the containers. The container holding portion has a margin extending along the loops, the margin adapted for tearing to individually release containers held by the carrier. A sleeve of stretchable material surrounds the group of containers, and has a parting line adapted for separation upon tearing of the margin.

In another form thereof, the invention provides a package of containers with a carrier including a plurality of loops, and a group of containers, one container disposed and secured in each loop. An outer margin portion on the carrier is adapted to be tom to release individual containers. A sleeve surrounds the group of containers, and is adapted for progressive parting to allow the outer margin portion to be pulled through the sleeve.

In a further form thereof, the invention provides a sleeve for a group of containers held in a carrier of stretchable plastic defining loops for surrounding each container. The sleeve comprises a band of stretchable material for surrounding the group and a parting line in the band for allowing a portion of the carrier to be pulled through the band.

An advantage of the present invention is providing a package that retains individual containers in a secure manner, while allowing selective release of fewer than all containers.

Another advantage of the present invention is providing a container package with a visual cue to the operation of individual release functions for the containers.

Other features and advantages of the invention will become apparent to those skilled in the art, upon review of the following detailed description, claims and drawings, in which like numerals are used to designate like features.

Figure 1:
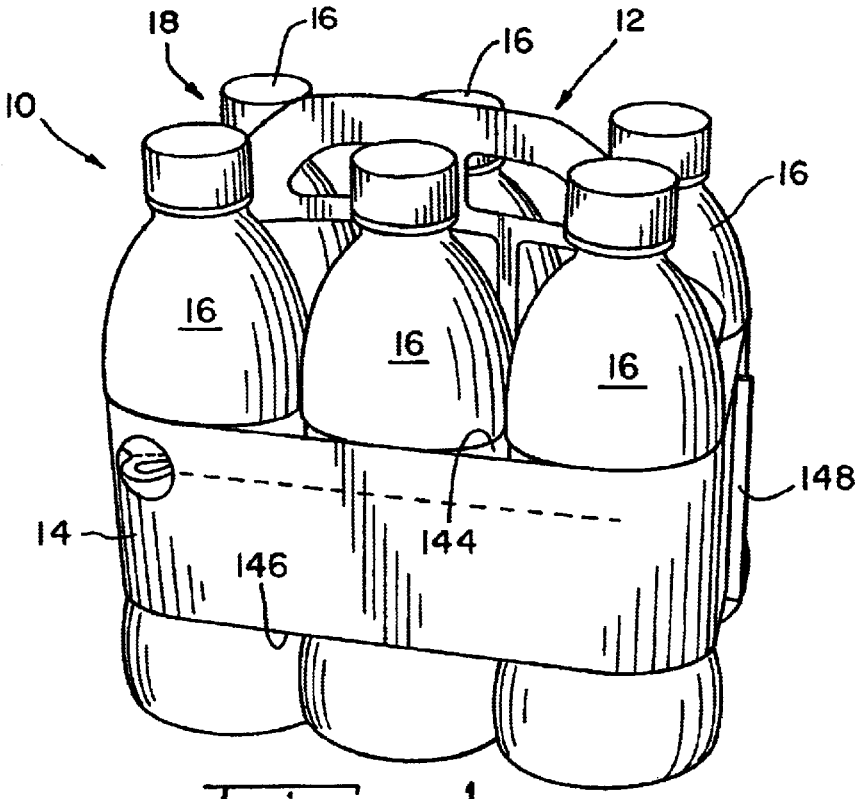
FIG. 1 is a perspective view of a container package in accordance with the present invention.

Before the embodiments of the invention are explained in detail, it is to be understood that the invention is not limited in its application to the details of construction and the arrangements of the components set forth in the following description, or illustrated in the drawings. The invention is capable of other embodiments and of being practiced or being carried out in various ways. Also, it is understood that the phraseology and terminology used herein are for the purpose of description, and should not be regarded as limiting. The use herein of "including" and "comprising", and variations thereof is meant to encompass the items listed thereafter, and equivalents thereof, as well as additional items and equivalents thereof.

DETAILED DESCRIPTION OF THE PREFERRED EMBODIMENT

Figure 7:
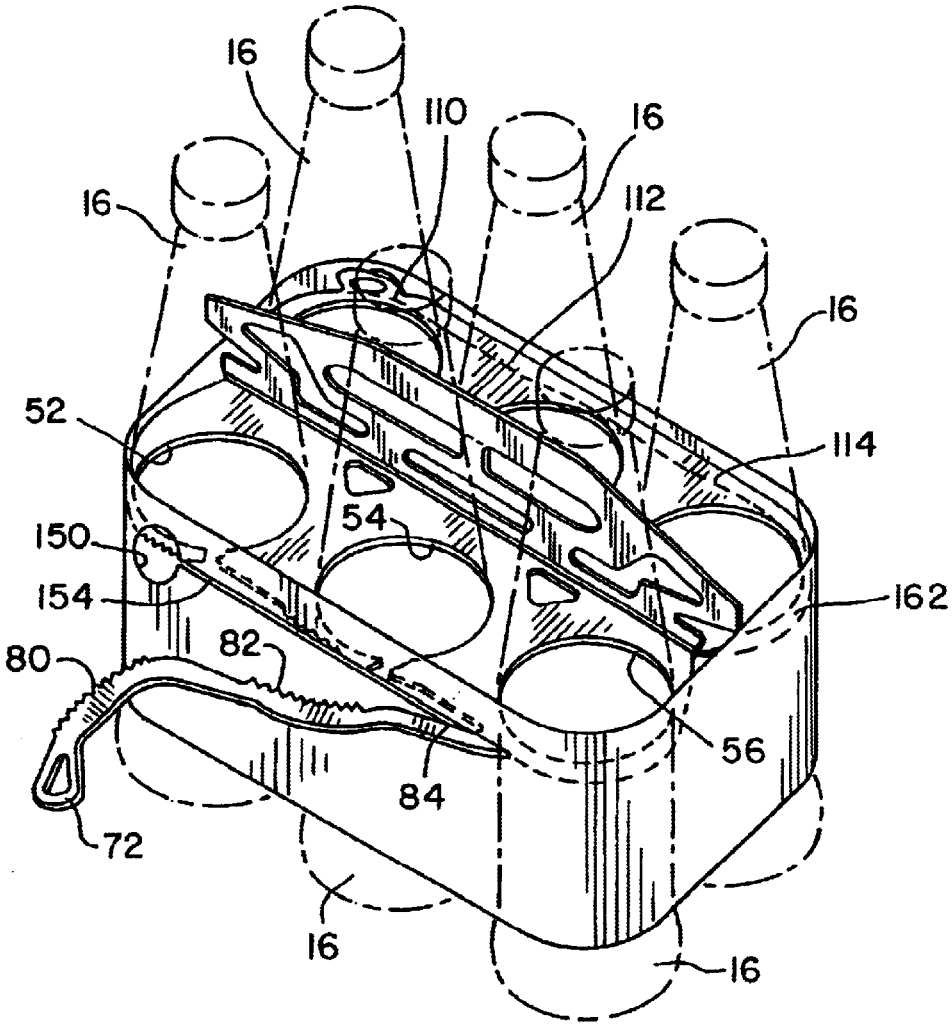
FIG. 7 is perspective view of a container package, with containers different from those in the previous Figures shown in phantom lines, illustrating the package tom to release containers on one side thereof.

Referring now more specifically to the drawings, and to FIG. 1 in particular, a container package 10 in accordance with the present invention is shown. Package 10 includes a carrier 12 and a sleeve 14. In the exemplary embodiment shown in the drawings, package 12 is provided for a so-called six-pack, and is shown for packaging a plurality of individual containers 16 into a group 18 of containers 16. However, it should be understood that the present invention can be used advantageously for packaging more or fewer containers 16 than the six-pack shown. Further, while package 12 is illustrated for packaging individual containers 16 in the form of bottles, package 12 can be used for packaging containers 16 other than bottles. For example, package 10 can be used also for packaging cans, and for bottles of different shapes. FIG. 7 illustrates containers 16 in phantom lines, of a shape different than containers 16 shown in FIG. 1.

Figure 2:
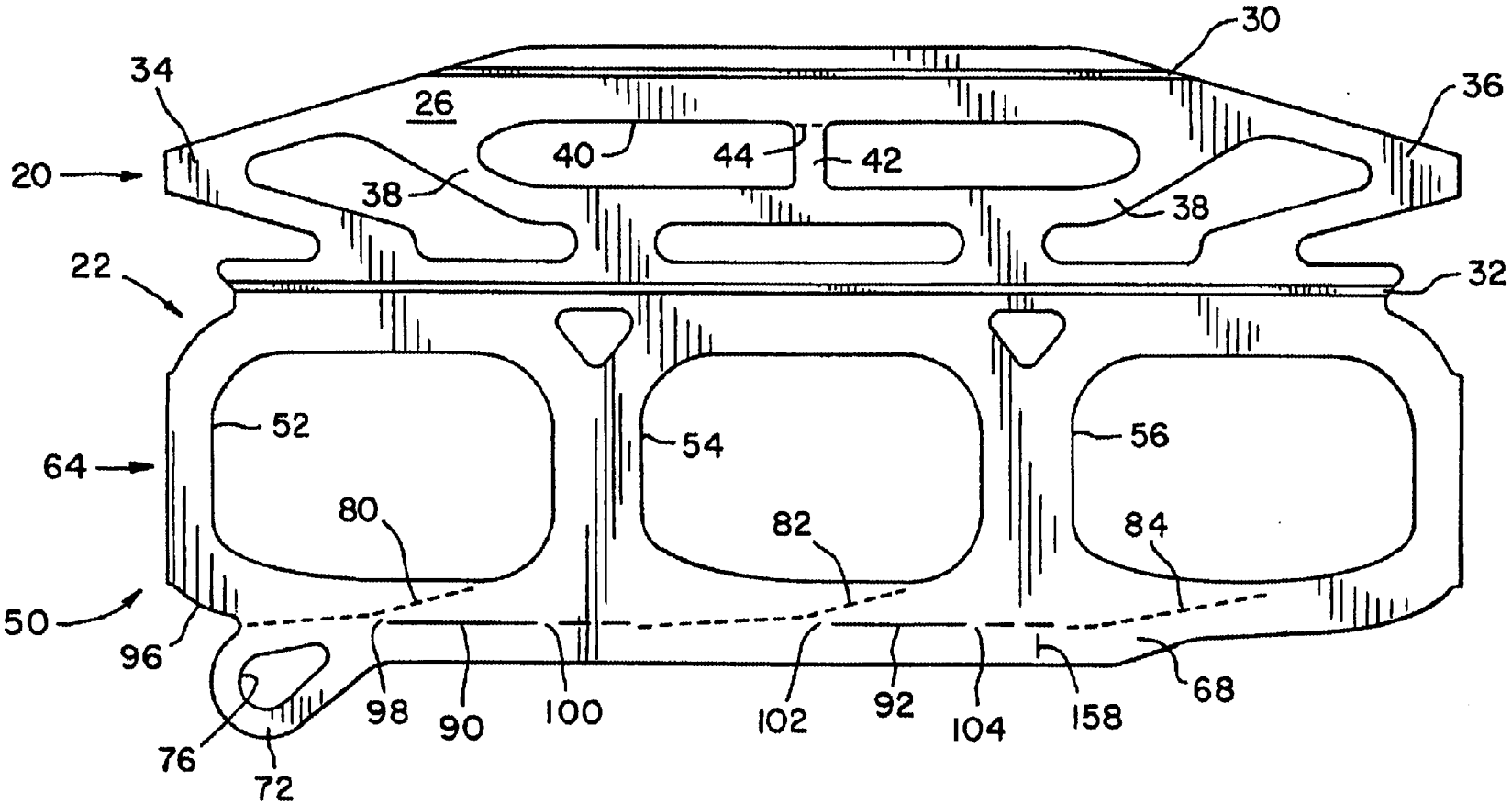
FIG. 2 is an enlarged plan view of a carrier in the container package shown in FIG. 1.
Figure 4:
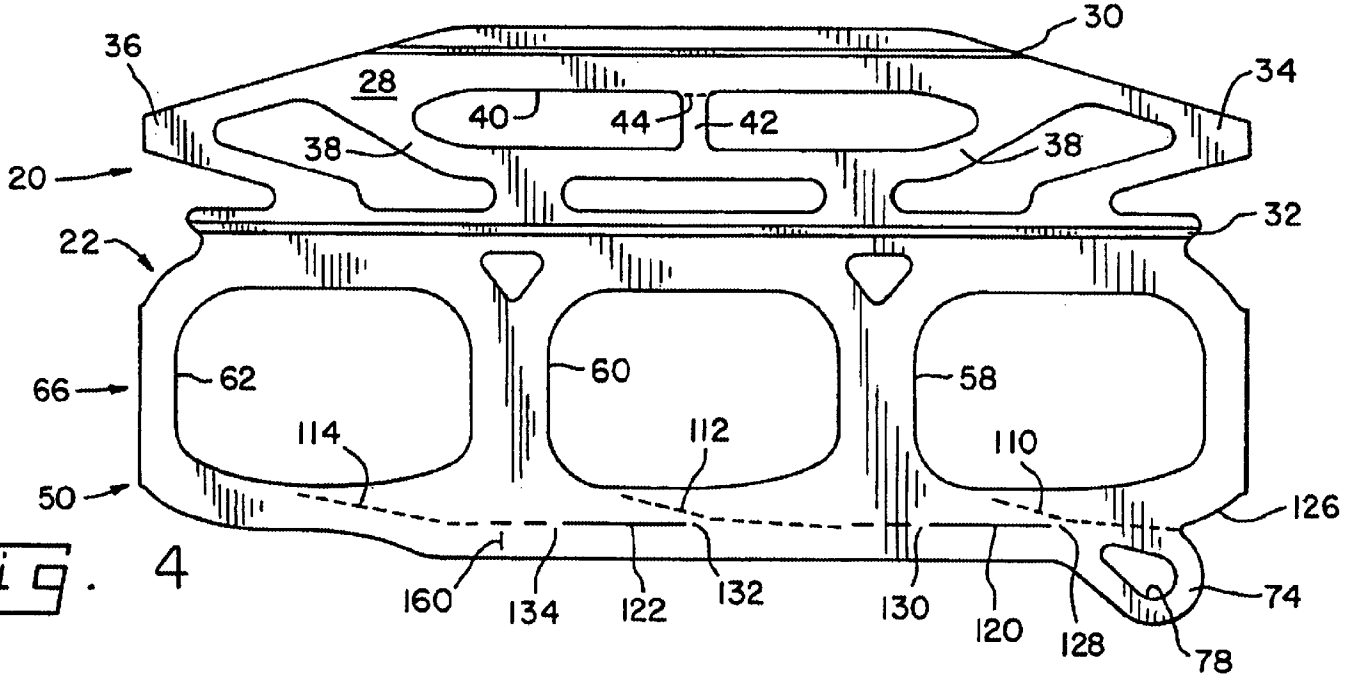
FIG. 4 is an enlarged plan view of the carrier shown in FIG. 2, but illustrating the side opposite the side shown in FIG. 2.

With reference to FIGS. 2 and 4, opposite sides of carrier 12 are illustrated. Carrier 12 includes a handle and suspension portion 20 and a container holding portion 22. The configuration of carrier 12 will vary depending on the size, type and quantity of containers 16 to be held in carrier 12. In a preferred design for carrier 12 to hold a six pack as illustrated, carrier 12 is a two-ply structure having a first sheet 26 (FIG. 2) and second sheet 28 (FIG. 4) juxtaposed on each other. First sheet 26 and second sheet 28 are connected by one or more welds 30, 32, two such welds 30 and 32 shown in the drawings. The manner in which such welds can be made is well known to those skilled in the art, and may include the application or extrusion of material between first sheet 26 and second sheet 28, to cause the sheets to fuse together. As illustrated, welds 30 and 32 are provided, respectively, near a top of handle portion 20 and a near container holding portion 22. An additional weld or welds may be provided between those illustrated. Handle portion 20, and container holding portion 22 are formed as integral portions of each sheet 26 and 28. Welds 30, 32 bond sheets 26 and 28 such that the portions 20 and 22 form a single integral carrier 12.

Handle portion 20 is a double thick layer that includes a plurality of struts 34, 36 and 38, including first and second end struts 34 and 36, respectively, and a plurality of intermediate struts 38 formed in each first sheet 26 and second sheet 28. Handle portion 20 further includes a handle opening 40 formed through the double layer of first sheet 26 and second sheet 28. A tie 42 interconnects the top and bottom of handle opening 40 during manufacture, to keep carrier 12 flat. Tie 42 ruptures readily along a perforate line 44 when container package 10 is lifted, making handle portion 12 more readily accessible and comfortable in use.

Container holding portion 22 comprises an array 50 of individual loops 52, 54, 56, 58, 60 and 62 generally below handle portion 20. As those skilled in the art will understand, each of loops 52, 54, 56, 58, 60 and 62 is a single-ply layer of material, with a first row 64 thereof, including loops 52, 54 and 56 being formed in first sheet 26 and a second row 66 thereof, including loops 58, 60 and 62 being formed in second sheet 28.

Each loop 52, 54, 56, 58, 60 and 62 is configured to be stretched and totally surround an individual container 16. The material for sheets 26 and 28 is both flexible and resilient, permitting significant stretching without breaking. Low-density polyethylene is a suitable plastic from which carrier 12 can be made.

Sheet 26 is provided with an outer margin portion 68, extending along loops 52, 54 and 56, and sheet 28 is provided with an outer margin portion 70 extending along loops 58, 60 and 62. Margin portions 68 and 70 define tabs 72 and 74, respectively, at one end thereof. In the embodiment illustrated, tabs 72 and 74 are provided at the same end of carrier 12. Tabs 72 and 74 are provided to be grasped by the consumer, and can define holes 76 and 78, respectively, to facilitate griping by the consumer.

Lines of perforations 80, 82 and 84 (FIG. 2) are provided in margin portion 68, angling toward loops 52, 54 and 56, respectively. An elongated slit 90 extends from near perforations 80 to near perforations 82, and an elongated slit 92 extends from near perforations 82 to near perforations 84. Perforations 80, 82 and 84 are each a series of relatively short, spaced cuts through sheet 26, along which sheet 26 can be torn. Slits 90 and 92 are continuous, elongated cuts through sheet 26. Perforations 80 extend from an edge 96 of carrier 12 just above tab 72 toward the interior of loop 52. Perforations 82 extend from near slit 90 toward the interior of loop 54. Perforations 84 extend from near slit 92 toward the interior of loop 56. Frangible links 98 and 100 are provided between perforations 80 and slit 90, and between slit 90 and perforations 82, respectively. Frangible links 102 and 104 are provided between perforations 82 and slit 92, and between slit 92 and perforations 84, respectively.

Lines of perforations 110, 112 and 114 (FIG. 4) are provided in margin portion 70, angling toward loops 58, 60 and 62, respectively. An elongated slit 120 extends from near perforations 110 to near perforations 112, and an elongated slit 122 extends from near perforations 112 to near perforations 114. Perforations 110, 112 and 114 are each a series of relatively short, spaced cuts through sheet 28, along which sheet 28 can be torn. Slits 120 and 122 are continuous, elongated cuts through sheet 28. Perforations 110 extend from an edge 126 of carrier 12 just above tab 74 toward the interior of loop 58. Perforations 112 extend from near slit 120 toward the interior of loop 60. Perforations 114 extend from near slit 122 toward the interior of loop 62. Frangible links 128 and 130 are provided between perforations 110 and slit 120, and between slit 120 and perforations 112, respectively. Frangible links 132 and 134 are provided between perforations 112 and slit 122, and between slit 122 and perforations 114, respectively.

Referring now particularly to FIG. 1, sleeve 14 is formed as an endless band surrounding the perimeter of group 18 of containers 16 held by carrier 12. Sleeve 14 has a top edge 140 and a bottom edge 142, with an open top 144 and an open bottom 146. Containers 16 extend above top edge 140 and below bottom edge 142, through open top 144 and open bottom 146, respectively. Advantageously, sleeve 14 has a substantial height between top edge 140 and bottom edge 142, to provide a large billboard area to display information, and to provide greater stability to package 10. Sleeve 14 can be formed from a strip of stretchable material formed into an endless band by bonding ends of the strip at a seam 148.

Figure 3:
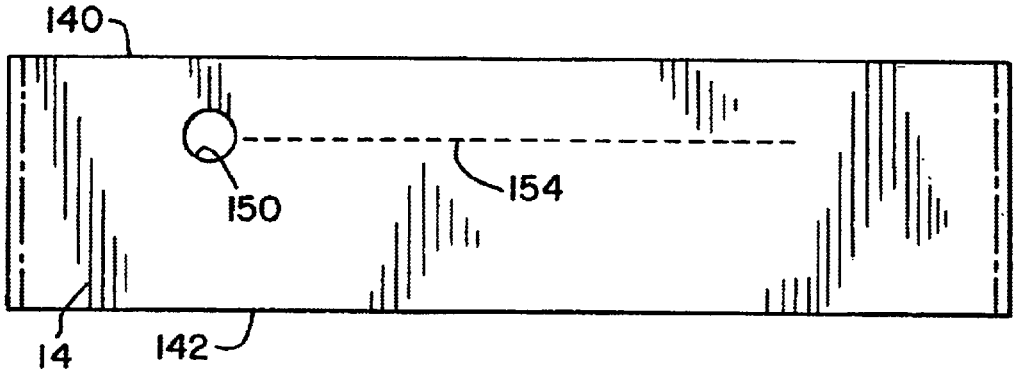
FIG. 3 is an elevational view of the sleeve shown in FIG. 1.
Figure 5:
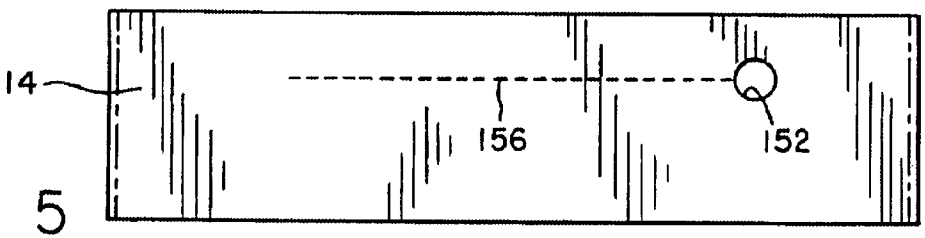
FIG. 5 is an elevational view of the sleeve, showing the side opposite the side shown in FIG. 3.

In a preferred structure of package 10, array 50 is disposed within sleeve 14. That is, loops 52, 54, 56, 58, 60 and 62 engage containers 16 at a position on containers 16 between the level of top edge 140 and bottom edge 142. To facilitate the release of individual containers 16, sleeve 14 is provided with apertures 150 and 152, and parting lines 154 and 156 extending therefrom (seen best in FIGS. 3 and 5). Apertures 150 and 152 are aligned with tabs 72 and 74 such that tabs 72 and 74 projected outwardly through apertures 150 and 152, respectively, allowing easy grasping thereof by a consumer. Parting lines 154 and 156 originate at apertures 150 and 152, respectively, and extend along sleeve 14, generally in line with margin portions 68 and 70, respectively. Parting lines 154 and 156 are spaced perforations, allowing relatively easy breaching of sleeve 14 from within sleeve 14, as tabs 72 and 74 are pulled during a release procedure, to be described in greater detail hereinafter.

In a contemplated procedure for using package 10, sleeve 14 is applied after carrier 12 has been attached to individual containers 16. Sleeve 14 is stretched to surround group 18 of containers 16, and is positioned there around to cover array 50 of carrier 12. The application of carrier 12 to individual containers 16 to form group 18, and the placement of sleeve 14 around group 18 can be performed with automated equipment known to those skilled in the art.

Sleeve 14 stabilizes group 18, minimizing the degree to which individual containers 16 can twist or skew relative to other containers 16 within group 18. The cooperative association of carrier 12 and sleeve 14 provides a firm, stable feel to the package, increasing the comfort and confidence of consumers carrying the package.

Figure 6:
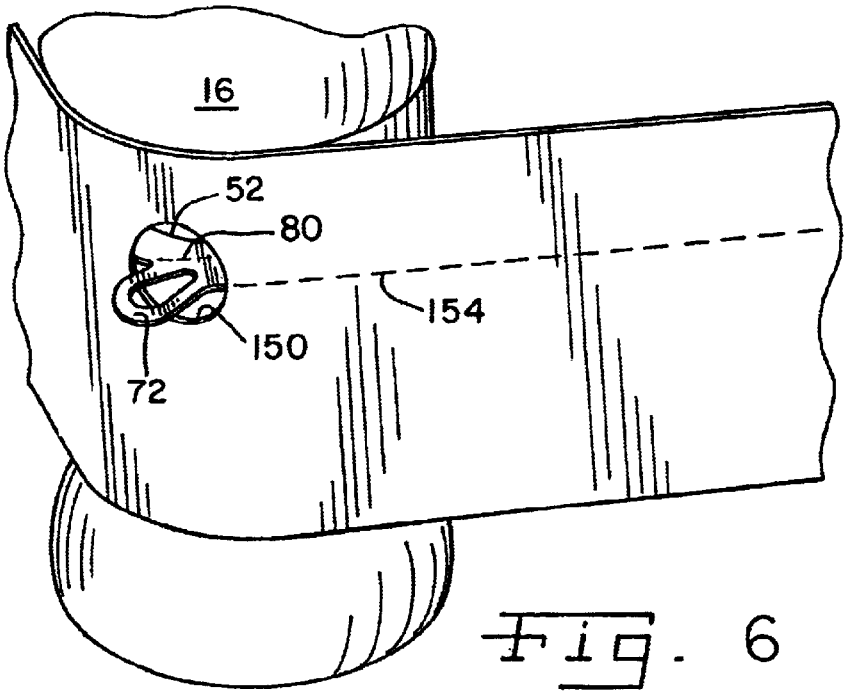
FIG. 6 is an enlarged perspective view of a portion of the container package shown in FIG. 1.

FIG. 7 illustrates the manner in which individual containers 16, illustrated as bottles 16 in phantom lines, are released from container package 10. Tab 72 projecting through aperture 150 (shown in enlarged detail in FIG. 6) is grasped and pulled to initiate tearing of margin portion 68. Tabs 72 and 74 projecting outwardly of relatively smooth surfaced sleeve 14 provide a strong visual clue of the presence of an opening feature, and the manner in which it is to be used. However, additionally sleeve 14 provides an area for printing instructions, which may be as simple as arrows adjacent apertures 150 and 152 indicating the direction in which tabs 72 and 74 should be pulled.

As tab 72 is pulled, margin portion 68 is torn along perforations 80, until loop 52 is breached. As the tear progresses along perforations 80, the separated length of outer margin portion 68 is pulled through sleeve 14, breaking along and through parting line 154.

A second container 16 can be released continuously or at some time subsequent to the release of the first container 16. Pulling of tab 72 is continued, breaking frangible link 98, opening slit 90 and breaking frangible link 100. Margin portion 68 is torn along perforations 82, until loop 54 is breached, and the second container is released. The additional separated length of outer margin portion 68 is pulled through sleeve 14 by breaking through yet a further length of parting line 154.

To release yet a third container 16, tab 72 is pulled still further, breaking frangible link 102, opening slit 92 and breaking frangible link 104. Margin portion 68 is torn along perforations 84, breaching loop 56 and releasing the third container 16. As additional lengths of outer margin portion 68 are separated, parting line 154 in sleeve 14 is broken further.

To release containers 16 held in loops 58, 60 and 62, a similar sequential process is followed, leading to the sequential breaching of loops 58, 60 and 62. Margin portion 70 is torn along perforations 110 to breach loop 58. Frangible links 128 and 130 are broken, and margin portion 70 is torn along perforations 112 to breach loop 60. Frangible links 132 and 134 are broken, and margin portion 70 is tom along perforations 114 to breach loop 62. As lengths of outer margin portion 70 are separated, parting line 156 in sleeve 14 is broken to allow outer margin portion 70 to be pulled away as necessary to break the frangible links and breach loops 58, 60 and 62 by tearing margin portion 70.

In the preferred embodiment shown, the separated lengths of outer margin portions 68 and 70 remain attached to carrier 12 after the last container 16 is released on each side. Alternatively, additional perforations, a frangible link 158, 160 or the like can be provided in margin portions 68 and 70, respectively, allowing segments of margin portions 68 and 70 to be completely removed and discarded.

The present invention provides improved stability by providing an encircling band for stabilizing containers held in a carrier, with cooperative association of th carrier and band in facilitating the release of a single container, or several containers in succession.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention, and will enable others skilled in the art to utilize the invention. The claims are to be construed to include alternative embodiments to the extent permitted by the prior art.

Various features of the invention are set forth in the following claims.

What is claimed is:

1. A package for a group of containers including individual containers to be held in rows, said package comprising;

an integral plastic carrier including a contain holding portion of interconnected stretchable loops, one said loop for each said container, each said loop surrounding a different one of said containers, said container holding portion having a margin extending along said loops, said margin adapted for tearing to individually release containers held by said carrier; and a sleeve of stretchable material surrounding the group of containers, said sleeve having a parting line adapted for separation in conjunction with tearing of said margin.

2. The package of claim 1, said margin defining a tab and a plurality of lines of perforations arranged in succession along said margin, one said line of perforations extending toward each said loop.

3. The package of claim 2, said sleeve defining an aperture, and said tab projecting outwardly through said aperture.

4. The package of claim 3, said parting line originating at said aperture, and being spaced perforations in said sleeve.

5. The package of claim 1, said carrier having two rows of loops and a separate said margin along each said row, each said margin adapted for tearing to individually release containers held by said carrier.

6. The package of claim 5, each said margin defining a tab and a plurality of lines of perforations arranged in succession along said margin, one said perforate line extending toward each said loop.

7. The package of claim 6, said sleeve defining two apertures and a different one of said tabs projecting outwardly through each of said apertures.

8. The package of claim 7, said sleeve having two said parting lines, one said parting line associated with each said margin.

9. The package of claim 8, each said parting line originating at one of said apertures, and each said parting line being spaced perforations in said sleeve.

10. A package of containers, comprising;

a carrier including a plurality of loops;

a group of containers, one said container disposed and secured in each said loop;

an outer margin portion of said carrier adjacent said loops adapted to be torn to release individual containers from said loops; and a sleeve surrounding said group of containers, said sleeve adapted for progressive parting in conjunction with tearing of said margin portion to allow said outer margin portion to be pulled through said sleeve as said outer margin portion is torn.

11. The package of containers of claim 10, said sleeve having a parting line of discrete perforations.

12. The package of containers of claim 11, said outer margin portion having a tab, said sleeve defining an aperture adjacent said parting line, and said tab projecting through said aperture.

13. The package of containers of claim 10, said group of containers including first and second rows, said carrier including two said outer margin portions each adapted to be torn to release individual containers from said loops, and said sleeve adapted for progressive parting in conjunction with tearing of said margin portion to allow each said outer margin portion to be pulled through said sleeve as said outer margin portions are torn.

14. The package of containers of claim 13, said sleeve having two parting lines of discrete perforations.

15. The package of containers of claim 14, each said outer margin portion having a tab, said sleeve defining two apertures, with a different said aperture adjacent each said parting line, and each said tab projecting through a different said aperture.

16. The package of containers of claim 10, said outer margin portion having lines of perforations along which said outer margin portion can be torn.

17. The package of containers of claim 16, said outer margin portion including a slit between adjacent said lines of perforations, and frangible links between said slit and said lines of perforations.

* * * * *